US011930888B2

(12) United States Patent
Chartrand

(10) Patent No.: US 11,930,888 B2
(45) Date of Patent: Mar. 19, 2024

(54) SKATE WITH ASYMMETRIC TONGUE

(71) Applicant: SPORT MASKA INC., Montreal (CA)

(72) Inventor: Daniel Chartrand, Lorraine (CA)

(73) Assignee: SPORT MASKA INC., Montreal (CA)

( * ) Notice: Subject to any disclaimer, the term of this patent is extended or adjusted under 35 U.S.C. 154(b) by 48 days.

(21) Appl. No.: 16/801,753

(22) Filed: Feb. 26, 2020

(65) Prior Publication Data

US 2020/0268096 A1 Aug. 27, 2020

Related U.S. Application Data

(60) Provisional application No. 62/811,081, filed on Feb. 27, 2019.

(51) Int. Cl.
*A43B 5/16* (2006.01)
*A43B 23/26* (2006.01)

(52) U.S. Cl.
CPC ..... *A43B 5/1666* (2013.01); *A43B 5/1625* (2013.01); *A43B 23/26* (2013.01)

(58) Field of Classification Search
CPC ..... A43B 5/16; A43B 5/1666; A43B 5/1625; A43B 5/1691; A43B 5/0405; A43B 23/26; A43C 11/20
USPC ..... 36/54, 115
See application file for complete search history.

(56) References Cited

U.S. PATENT DOCUMENTS 2,139,858 A * 12/1938 Schwartz ..... A43B 23/26 36/54
3,413,736 A * 12/1968 Spiteri ..... A43B 23/26 36/54
5,265,353 A * 11/1993 Marega ..... A43B 5/0405 36/117.6
5,946,825 A * 9/1999 Koh ..... A43B 23/028 36/55
5,946,826 A * 9/1999 Merle ..... A43B 5/04 36/50.5
6,237,253 B1 * 5/2001 Feuerecker ..... A43B 23/027 36/117.1
6,442,875 B1 * 9/2002 Joubert ..... A43B 7/142 36/117.6
7,290,355 B2 11/2007 Labonté
7,950,676 B2 5/2011 Goldsmith et al.
8,959,803 B2 2/2015 Pelletier, Jr. et al.
9,713,358 B2 7/2017 Pelletier, Jr. et al.
2005/0204585 A1 * 9/2005 Loveridge ..... A43B 23/047 36/54
2005/0210707 A1 * 9/2005 Labonte ..... A43B 5/1666 36/54
2005/0229436 A1 * 10/2005 Bock ..... A43B 5/1625 36/115
2012/0192453 A1 * 8/2012 Raysse ..... A43B 1/0081 36/54

(Continued)

*Primary Examiner* — Aiying Zhao
(74) *Attorney, Agent, or Firm* — NORTON ROSE FULBRIGHT CANADA

(57) ABSTRACT

A skate including a tongue mounted to a boot of the skate. The tongue has an upper end and a lower end, and a medial edge and a lateral edge, and a longitudinal center axis of the tongue extends between the upper and lower ends and is spaced equidistantly between segments of the medial and lateral edges. The longitudinal center axis divides the tongue into a medial segment and a lateral segment. The medial and lateral segments are asymmetrical about the longitudinal center axis.

24 Claims, 6 Drawing Sheets

(56) References Cited

U.S. PATENT DOCUMENTS

| | | | | |
|---|---|---|---|---|
| 2013/0312284 | A1* | 11/2013 | Berend | A43B 1/0072 36/84 |
| 2014/0033575 | A1* | 2/2014 | Cruikshank | A43B 5/1625 36/116 |
| 2016/0007674 | A1* | 1/2016 | Labonte | A43B 3/0078 36/54 |
| 2017/0303632 | A1* | 10/2017 | Pratt | A43B 3/248 |

* cited by examiner

SKATE WITH ASYMMETRIC TONGUE

CROSS-REFERENCE TO RELATED APPLICATION

This application claims priority on U.S. patent application Ser. No. 62/811,081 filed Feb. 27, 2019, the entire contents of which are incorporated herein by reference.

TECHNICAL FIELD

The application relates generally to skates and, more particularly, to a tongue for ice skates.

BACKGROUND

The tongue of an ice skate abuts against a dorsal surface of the foot of the wearer of the skate. The foot is typically secured in place within a boot of the skate by tightening the laces over the tongue. Even after being tightened against the foot, some tongues have a tendency to slide off to the side of the foot during the skating motion, and may thus become uncomfortable. Furthermore, the tightening of the tongue over the foot may cause or exacerbate a painful phenomenon commonly known as "lace bite".

SUMMARY

In one aspect, there is provided a skate for a foot of a wearer, the foot having a top surface, a bottom surface, a medial side, and a lateral side, the skate comprising: a boot having a shell with a bottom portion shaped to enclose the bottom surface of the foot, a lateral side portion shaped to enclose the lateral side of the foot, and a medial side portion shaped to enclose the medial side of the foot, the boot including a toe portion to cover toes of the wearer; and a tongue engaged to the boot and extending along a length between an upper end and a lower end adjacent to the toe portion of the boot, the tongue having a medial edge adjacent to the medial side portion of the shell and a lateral edge adjacent to the lateral side portion of the shell, a longitudinal center axis of the tongue extending between the upper and lower ends and spaced equidistantly between the medial and lateral edges at at least one point of the length of the tongue, the longitudinal center axis dividing the tongue into a medial segment having a medial segment width defined from a point on the longitudinal center axis to the medial edge, and a lateral segment having a lateral segment width defined from the point on the longitudinal center axis to the lateral edge, the lateral segment width being different from the medial segment width at the point on the longitudinal center axis.

The skate as defined herein may further include may further include, one or more of the following features in any combination:

- the lateral segment width is greater than the medial segment width at the point on the longitudinal center axis;
- the medial edge of the tongue has a recessed segment having a recessed medial edge, the recessed medial edge being closer to the longitudinal center axis than a remainder of the medial edge, the recessed medial edge delimiting a void shaped to receive therein at least a portion of medial malleolus of the wearer;
- the medial segment width is defined from the point on the longitudinal center axis to the recessed medial edge, the medial segment width being less than the lateral segment width at the point on the longitudinal center axis;
- the tongue further comprises a tab disposed on the lateral segment adjacent to the upper end of the tongue, the tab extending outwardly from the lateral edge in a direction away from the longitudinal center axis, the tab being positionable between the top surface of the foot and an underside of the lateral side portion of the shell;
- the tongue includes a folding zone extending between the medial and lateral edges and defining a folding axis being transverse to the longitudinal center axis, the upper and lower ends of the tongue being foldable towards one another about the folding axis;
- the folding zone is disposed between the upper and lower ends of the tongue to position the folding axis above the top surface of the foot and in alignment with a dorsiflexion-plantarflexion axis of the foot;
- the tongue has an inner surface to face towards the top surface of the foot, and an exposed outer surface, the tongue further comprising a protrusion extending from the inner surface towards the top surface of the foot, the protrusion being positioned on the lateral segment of the tongue to overlay a portion of lateral metatarsals of the foot of the wearer; and
- the skate is an ice skate and the shell of the boot is more rigid than the tongue.

In another aspect, there is provided a tongue adapted to be mounted within a boot of a skate, the tongue comprising: an upper end and a lower end, and a medial edge and a lateral edge, a longitudinal center axis of the tongue extending between the upper and lower ends and spaced equidistantly between segments of the medial and lateral edges, the longitudinal center axis dividing the tongue into a medial segment having a medial segment width defined from a point on the longitudinal center axis to the medial edge, and a lateral segment having a lateral segment width defined from the point on the longitudinal center axis to the lateral edge, the lateral segment width being different from the medial segment width at the point on the longitudinal center axis.

The tongue as defined herein may further include, one or more of the following features in any combination:

- the lateral segment width is greater than the medial segment width at the point on the longitudinal center axis;
- the medial edge of the tongue has a recessed segment having a recessed medial edge, the recessed medial edge being closer to the longitudinal center axis than a remainder of the medial edge, the recessed medial edge delimiting a void shaped to receive therein at least a portion of medial malleolus of a wearer of the skate;
- the medial segment width is defined from the point on the longitudinal center axis to the recessed medial edge, the medial segment width being less than the lateral segment width at the point on the longitudinal center axis;
- a tab disposed on the lateral segment adjacent to the upper end of the tongue, the tab extending outwardly from the lateral edge in a direction away from the longitudinal center axis;
- a folding zone extending between the medial and lateral edges and defining a folding axis being transverse to the longitudinal center axis, the upper and lower ends of the tongue being foldable towards one another about the folding axis;

the folding zone is disposed between the upper and lower ends of the tongue to position the folding axis in alignment with a dorsiflexion-plantarflexion axis of a foot; and an inner surface and an exposed outer surface, and a protrusion extending away from the inner surface, the protrusion being positioned on the lateral segment to overlay a portion of lateral metatarsals of a foot.

In a further aspect, there is provided a skate boot comprising a shell defining a foot receiving portion and a tongue mounted within the boot, the tongue including an upper end, a lower end, a medial edge and a lateral edge, a longitudinal center axis of the tongue extending between the upper and lower ends and spaced substantially equidistantly between segments of the medial and lateral edges, the longitudinal center axis dividing the tongue into a medial segment and a lateral segment, the medial and lateral segments being asymmetrical about the longitudinal center axis.

The skate boot as defined herein may further include, one or more of the following features in any combination:

the medial segment has a medial segment width defined from a point on the longitudinal center axis to the medial edge, and the lateral segment has a lateral segment width defined from the point on the longitudinal center axis to the lateral edge, the lateral segment width being different from the medial segment width at the point on the longitudinal center axis;

the lateral segment width being greater than the medial segment width at the point on the longitudinal center axis;

the medial edge of the tongue has a recessed segment having a recessed medial edge, the recessed medial edge being closer to the longitudinal center axis than a remainder of the medial edge, the recessed medial edge delimiting a void shaped to receive therein at least a portion of medial malleolus of a wearer of the skate;

the medial segment width being defined from the point on the longitudinal center axis to the recessed medial edge, the medial segment width being less than the lateral segment width at the point on the longitudinal center axis;

a tab disposed on the lateral segment adjacent to the upper end of the tongue, the tab extending outwardly from the lateral edge in a direction away from the longitudinal center axis;

a folding zone extending between the medial and lateral edges and defining a folding axis being transverse to the longitudinal center axis, the upper and lower ends of the tongue being foldable towards one another about the folding axis;

the folding zone being disposed between the upper and lower ends of the tongue to position the folding axis in alignment with a dorsiflexion-plantarflexion axis of a foot; and an inner surface and an exposed outer surface, and a protrusion extending away from the inner surface, the protrusion being positioned on the lateral segment to overlay a portion of lateral metatarsals of a foot.

In a further aspect, there is provided a skate for a foot of a wearer, the foot having a top surface, a bottom surface, a medial side, and a lateral side, the skate comprising: a boot having a shell with a bottom portion shaped to enclose the bottom surface of the foot, a lateral side portion shaped to enclose the lateral side of the foot, and a medial side portion shaped to enclose the medial side of the foot, the boot including a toe portion to cover toes of the foot; and a tongue engaged to the boot and having a length defined between an upper end and a lower end adjacent to the toe portion of the boot, the tongue having a medial edge adjacent to the medial side portion of the shell and a lateral edge adjacent to the lateral side portion of the shell, a medial segment of the tongue defined between the upper and lower ends and adjacent to the medial edge, and a lateral segment of the tongue defined between the upper and lower ends and adjacent to the lateral edge, the tongue having at least one comfort feature disposed at a location of the tongue, said comfort feature at said location of the tongue being disposed in only one of the medial and lateral segments of the tongue.

The skate as defined herein may further include one or more of the following features, in any combination:

at least one comfort feature includes a tab disposed on the lateral segment at a first location of the tongue adjacent to the upper end of the tongue, the tab extending outwardly away from the lateral edge, the tab being positionable between the top surface of the foot and an underside of the lateral side portion of the shell;

the tab is disposed on the lateral segment at a position greater than 50% of the length of the tongue measured from the lower end;

the tongue has an inner surface to face towards the top surface of the foot, and an exposed outer surface, the at least one comfort feature including a protrusion extending from the inner surface towards the top surface of the foot, the protrusion being positioned on the lateral segment at a second location of the tongue to overlay a portion of lateral metatarsals of the foot of the wearer;

the protrusion is disposed on the lateral segment at a position less than 50% of the length of the tongue measured from the lower end;

the at least one comfort feature includes a recessed segment disposed on the medial segment at a third location of the tongue, the recessed segment having a recessed medial edge, the recessed medial edge being closer to the lateral edge than a remainder of the medial edge, the recessed medial edge delimiting a void shaped to receive therein at least a portion of medial malleolus of the wearer; and the recessed segment is disposed on the medial segment at a position between 40% and 90% of the length of the tongue measured from the lower end.

In a further aspect, there is provided a tongue mountable within a boot of a skate, the tongue comprising: a length defined between an upper end and a lower end, a medial edge, and a lateral edge, a medial segment of the tongue defined between the upper and lower ends and adjacent to the medial edge, and a lateral segment of the tongue defined between the upper and lower ends and adjacent to the lateral edge, the tongue having at least one comfort feature disposed at a point on the tongue in the lateral segment of the tongue.

The tongue as defined herein may further include one or more of the following features, in any combination:

the at least one comfort feature includes at least one of: a tab adjacent to the upper end of the tongue, the tab extending outwardly away from the lateral edge; and a protrusion extending from an inner surface of the tongue to overlay a portion of lateral metatarsals of a foot of a wearer of the skate; and at least one medial comfort feature having a recessed segment disposed on the medial segment of the tongue, the recessed segment having a recessed medial edge, the recessed medial edge being closer to the lateral edge than a remainder of the medial edge, the recessed medial edge delimiting a void shaped to receive therein at least a portion of medial malleolus of the wearer.

In a further aspect, there is provided a tongue mountable within a boot of a skate, the tongue comprising: a length defined between an upper end and a lower end, a medial edge, and a lateral edge, a medial segment of the tongue defined between the upper and lower ends and adjacent to the medial edge, and a lateral segment of the tongue defined between the upper and lower ends and adjacent to the lateral edge, the tongue having at least one comfort feature disposed at a point on the tongue in the medial segment of the tongue.

The tongue as defined herein may further include one or more of the following features, in any combination:

the at least one comfort feature includes a recessed segment disposed on the medial segment of the tongue, the recessed segment having a recessed medial edge, the recessed medial edge being closer to the lateral edge than a remainder of the medial edge, the recessed medial edge delimiting a void shaped to receive therein at least a portion of medial malleolus of the wearer; and at least one lateral comfort feature including at least one of: a tab adjacent to the upper end of the tongue, the tab extending outwardly away from the lateral edge; and a protrusion extending from an inner surface of the tongue to overlay a portion of lateral metatarsals of a foot of a wearer of the skate.

BRIEF DESCRIPTION OF THE DRAWINGS

Reference is now made to the accompanying figures in which.

DETAILED DESCRIPTION

Figure 1A:
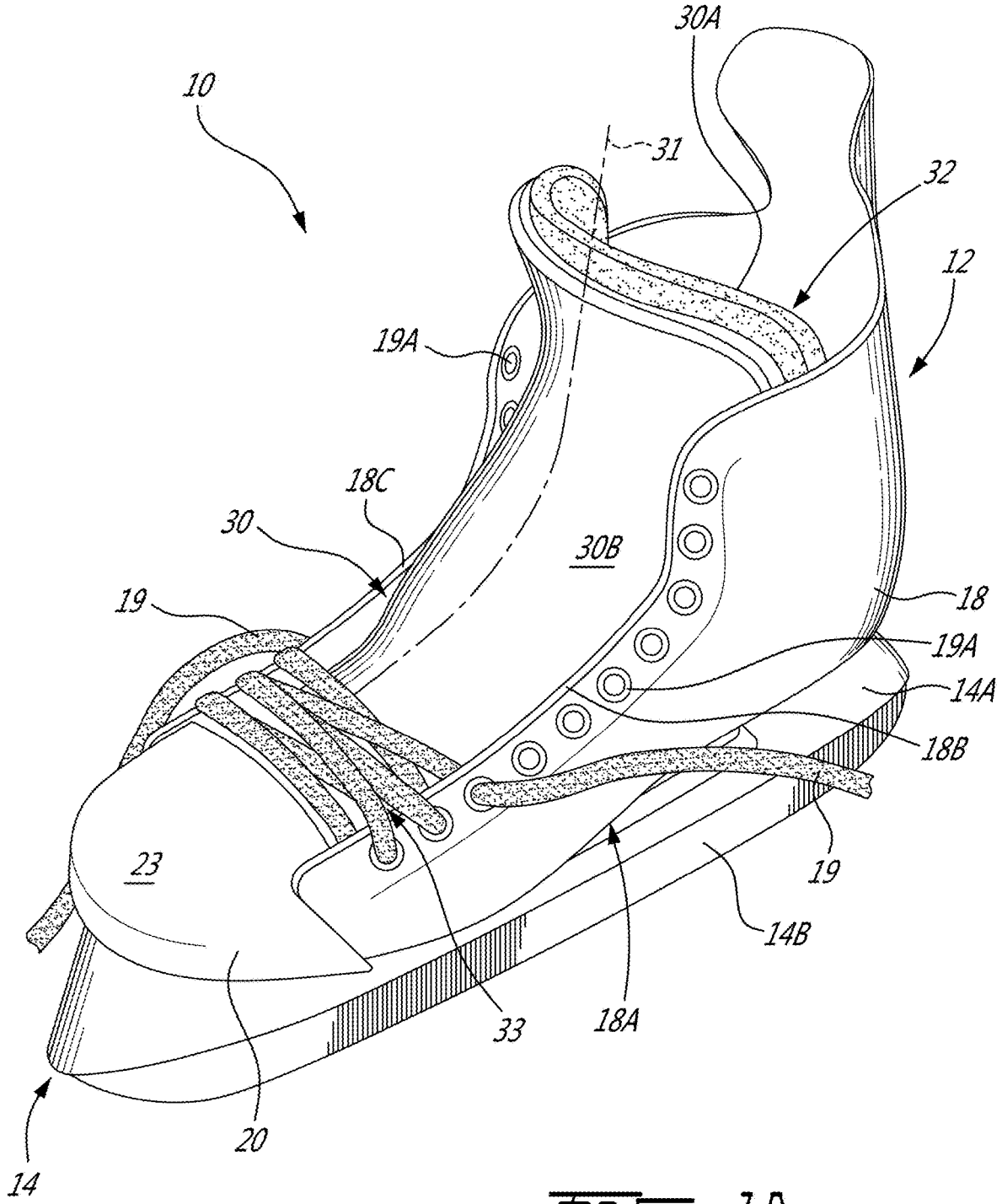
FIG. 1A is a schematic perspective view of a skate, in accordance with an embodiment of the present disclosure.

FIG. 1A illustrates a skate 10, of the type use for skating and ice hockey (i.e. an ice skate). The ice skate (or simply "skate") 10 has a skate boot 12, adapted to receive a foot of the wearer and thus defining a foot receiving portion, and a ground-engaging element 14 connected to the bottom of the boot 12. In FIG. 1A, the ground-engaging element 14 includes, in one embodiment, a blade holder 14A mounted to the bottom of the boot 12 and a blade 14B that is disposed in the blade holder 14A. Alternately, the ground-engaging element 14 may include wheels and an associated supporting structure—i.e. in the case of an inline skate. The boot 12 includes a shell 18 shaped to enclose the heel, the upper and lower parts of the Achilles tendon, and the medial and lateral surfaces of the foot F (see FIG. 1B) of a wearer of the skate 10. The boot 12 also includes a toe portion 20 to enclose toes of the foot F, shown here as a toe cap 23 connected to the shell 18. Alternately, the toe portion 20 can have any other suitable configuration, including, but not limited to, a toe portion integrally formed with the remainder of the boot 12 (e.g., a monocoque construction). The skate 10 further includes a tongue 30. The skate 10 is an ice skate in FIG. 1A, however it is contemplated that in other embodiments the skate 10 may be for other type of skating activities and have different types of ground-engaging elements 14. For example, in an embodiment, the skate 10 is a roller skate having a wheel holder and a set of wheels as the ground-engaging element 14. The shell 18 of the skate boot 12 may be formed of a material (such as composite) that is more rigid that the material forming the tongue 30 of the skate 10, which will be described in further detail below. The skate boot 12 may, in one particular embodiment, be a "non-lasted" skate boot that is formed by molding or other suitable techniques as an integral three-dimensional molded shell 18 (i.e. and not formed around a last).

Figure 1B:
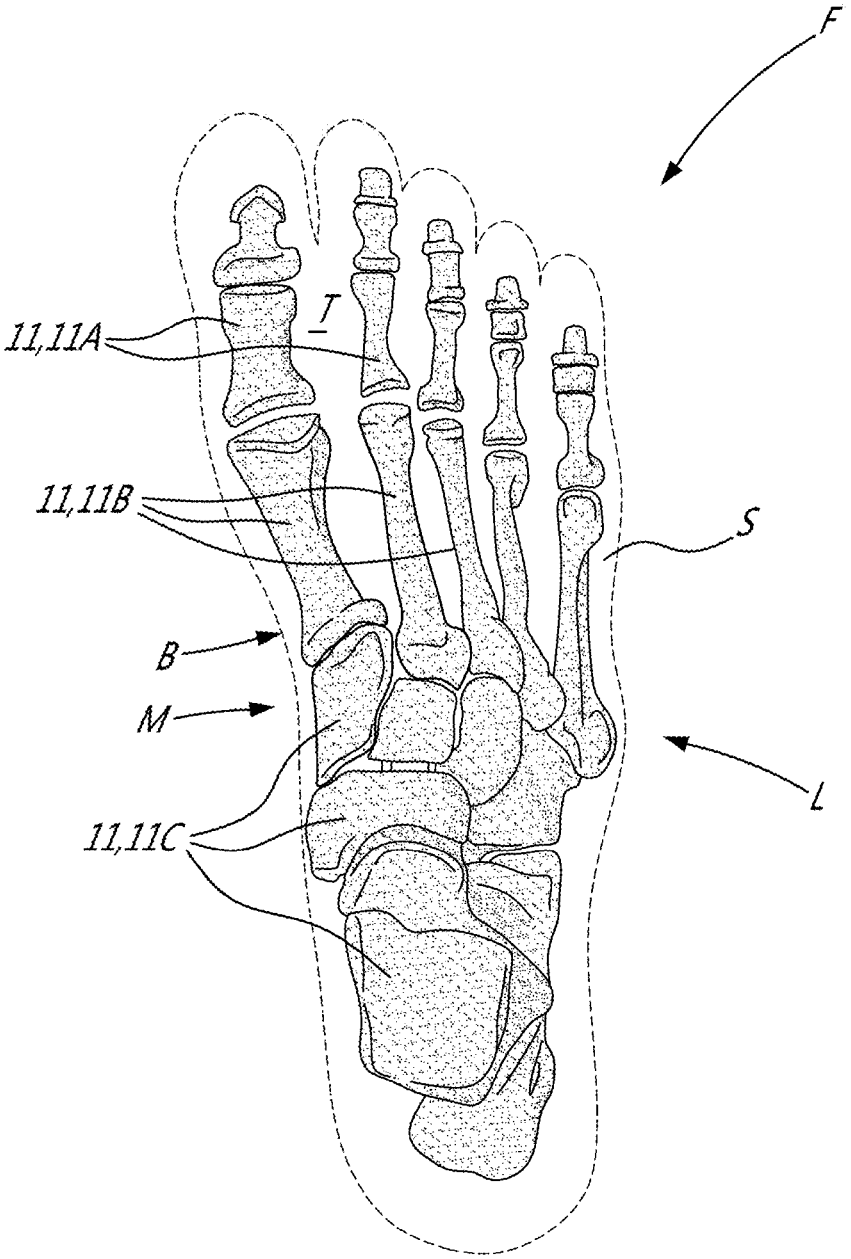
FIG. 1B is a top plan view of a human foot for the skate of FIG. 1A.

FIG. 1B is a dorsal or top plan view of the foot F of the wearer of the skate 10. The foot F has a skin S defining a dorsal or top surface T, a plantar or bottom surface B, a medial side M, and a lateral side L. The internal bones 11 of the foot F include phalange bones 11A, metatarsal bones 11B, and tarsal bones 110, to name but a few. Referring to FIG. 1A, the shell 18 has portions which enclose and support the foot F. The shell 18 has a bottom portion 18A shaped to enclose the bottom surface B of the foot F, a lateral side portion 18B shaped to enclose the lateral side L, and a medial side portion 18C shaped to enclose the medial side M.

The tongue 30 is adapted to fit between the medial and lateral sides 18B, 18C of the shell 18. The tongue 30 is thus located in part within the shell 18 of the boot 12, such that the tongue 30 covers the top surface T and the front ankle portion of the foot F. The tongue 30 is engaged with the shell 12. In the depicted embodiment, the tongue 30 is removably connected to the toe cap 23 or toe portion 20, however the tongue 30 may also, in another embodiment, be more permanently fixed (such as by sewing, stitching, bonding, etc.) to the shell 18 of the boot 12. The tongue 30 has an inner surface 30A to face towards, and abut against, the top surface T of the foot F, and an exposed outer surface 30B facing away from the foot F. The tongue 30 is elongated, and extends along a length defined between an upper end 32 and a lower end 33. A longitudinal center axis 31 extends along the length of the tongue 30 between its upper end 32 and lower end 33. As will be seen, the longitudinal center axis 31 of the tongue 30 is spaced substantially equidistantly between a medial edge 34A and a lateral edge 34B, at least one point along length of the tongue 30. This may be, for example, at either of the upper and lower ends 32, 33, or at any one or more points therebetween.

The upper end 32 is positioned closer to the shin of the wearer when the skate 10 is worn, and the lower end 33 is positioned adjacent to the toes. The boot 12 includes a lace 19 that extends through lace eyelets 19A in the medial and lateral sides 18B, 18C of the shell 18 in a criss-crossing pattern. As such, when the lace 19 is tightened, the lace 19 acts to keep the tongue 30 in place against the foot F.

Figure 2A:
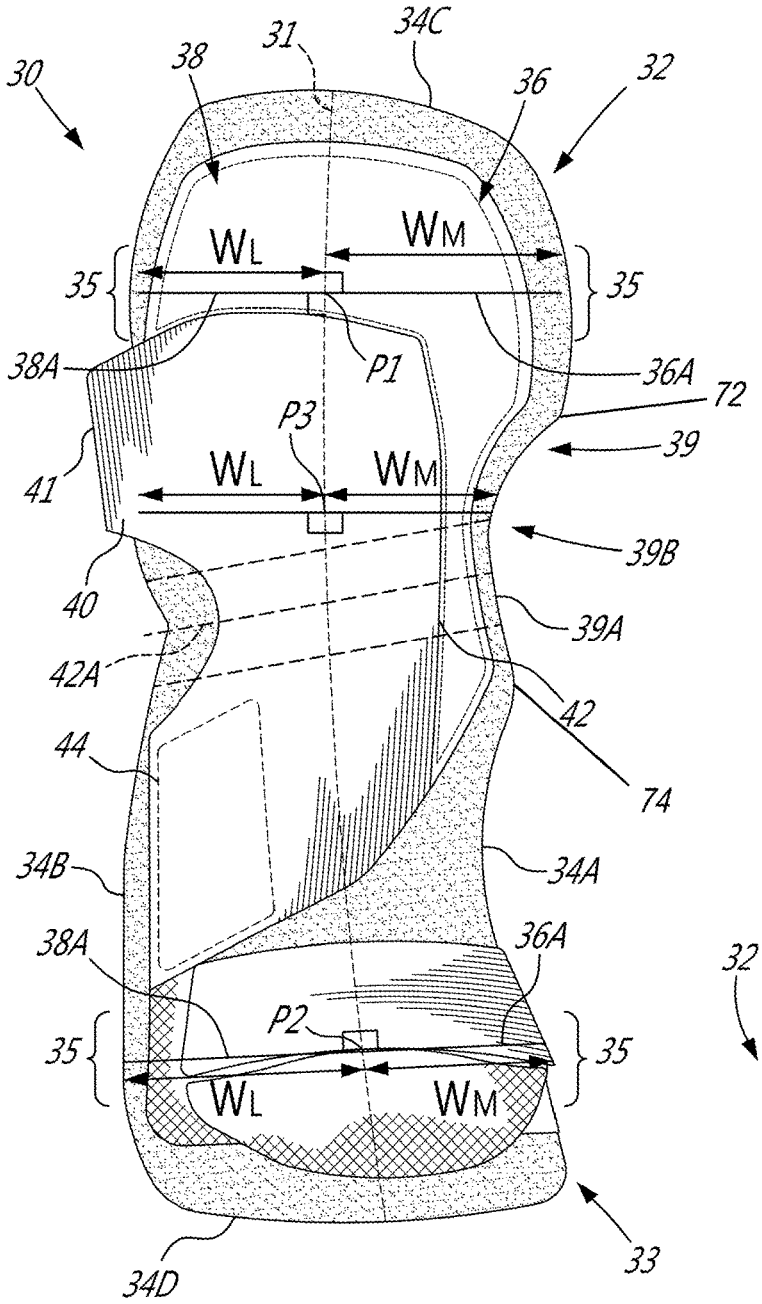
FIG. 2A is a schematic perspective view of a tongue of the skate of FIG. 1A, shown for use with a right foot.
Figure 2B:
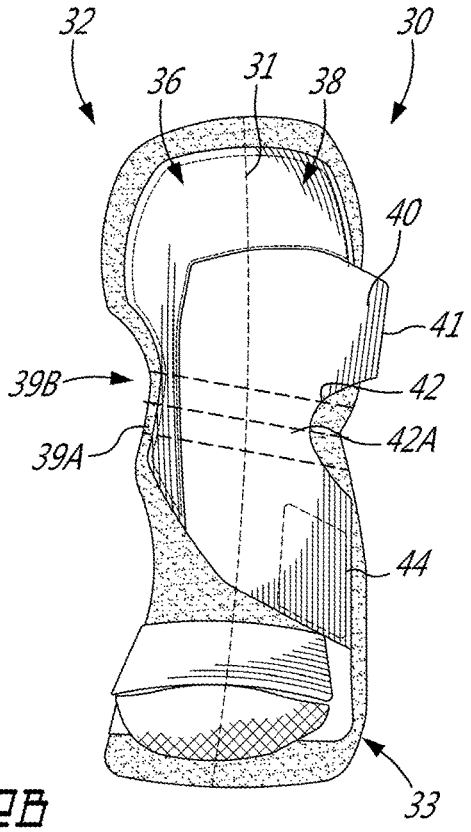
FIG. 2B is a schematic perspective view of the tongue of the skate of FIG. 1A, shown for use with a left foot.
Figure 3A:
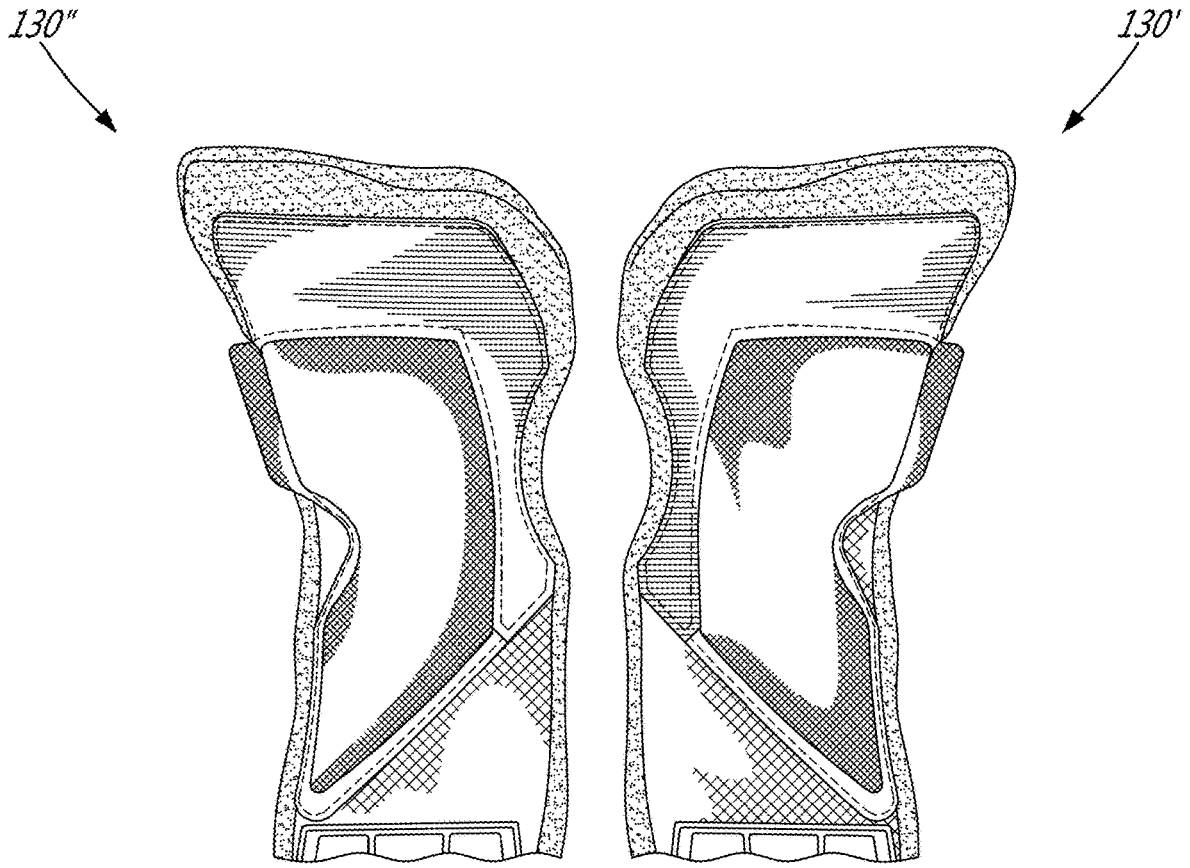
FIG. 3A is a schematic perspective view of left and right tongues of a pair of skates, such as that shown in FIG. 1A.
Figure 3B:
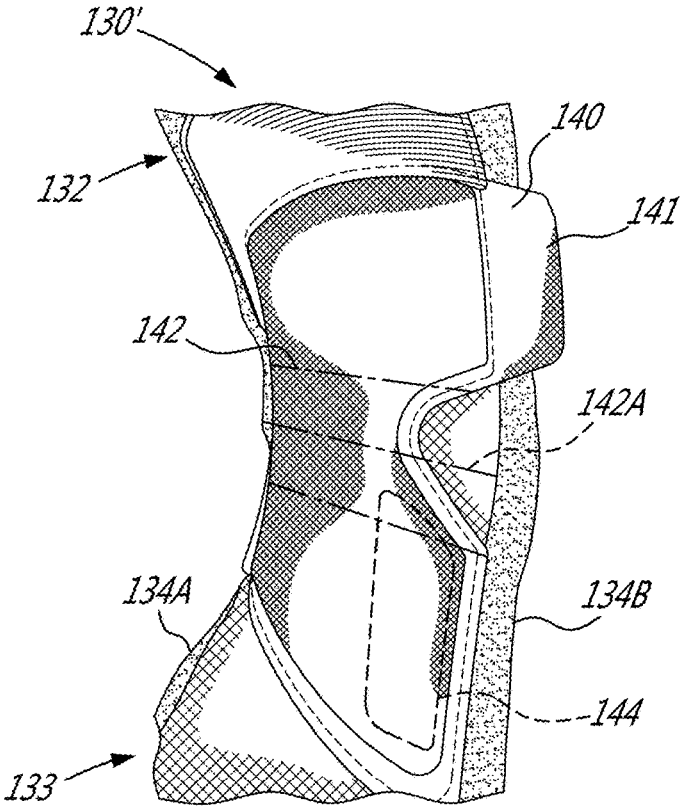
FIG. 3B is a schematic perspective view of the left tongue of FIG. 3A.
Figure 3C:
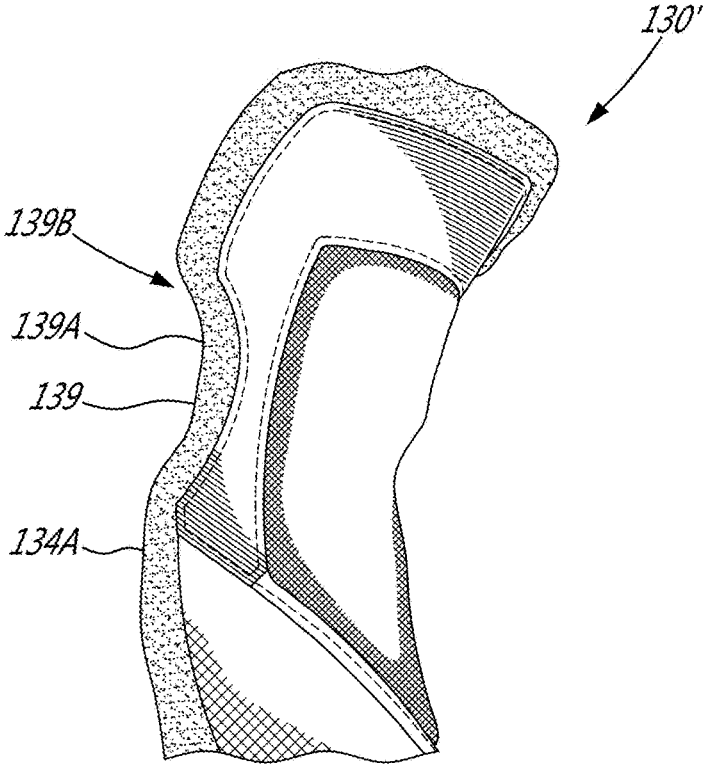
FIG. 3C is another schematic perspective view of the left tongue of FIG. 3A.
Figure 3D:
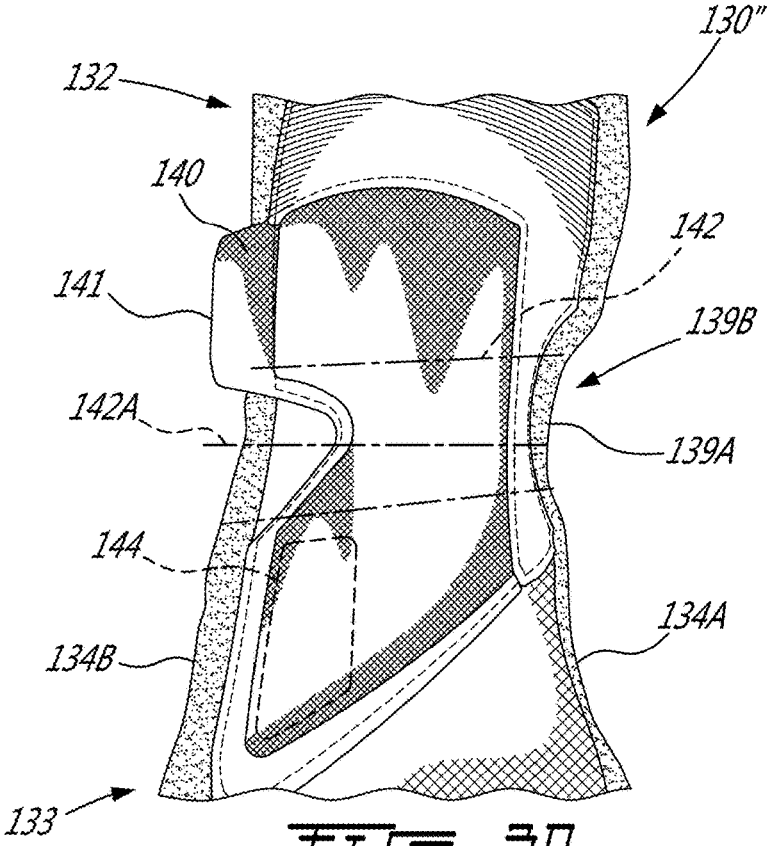
FIG. 3D is a schematic perspective view of the right tongue of FIG. 3A.
Figure 3E:
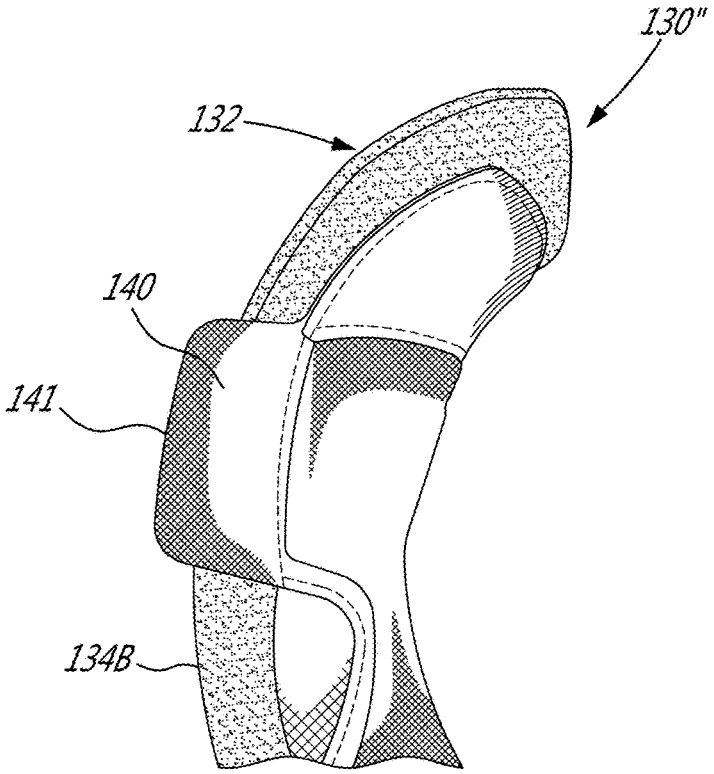
FIG. 3E is another schematic perspective view of the right tongue of FIG. 3A.

FIGS. 2A and 2B show the tongue 30 for use with a right foot F of the wearer of the skate 10 (FIG. 2A), and for use with a left foot F of the wearer of the skate 10 (FIG. 2B). The tongue 30 has a medial edge 34A which, when the foot F is placed in the skate 10, is on the medial side M of the foot F and is adjacent to the medial side portion 18C of the shell 18. The tongue 30 also has a lateral edge 34B which, when the foot F is placed in the skate 10, is on the lateral side L of the foot F and is adjacent to the lateral side portion 18B of the shell 18. The medial and lateral edges 34A,34B are peripheral edges of the tongue 30. The medial and lateral edges 34A,34B intersect other peripheral edges of the tongue 30, such as the upper edge 34C at the upper end 32 of the tongue 30 and the lower edge 34D at the lower end 33. The medial edge 34A is the portion of the tongue 30 which is closest to the longitudinal axis of the body of the wearer when the skate 10 is worn, and the lateral edge 34B is the portion of the tongue 30 which is furthest away from the longitudinal axis of the body of the wearer when the skate 10 is worn.

The longitudinal center axis 31 is an approximate centerline or midline of the tongue 30, and extends between the upper and lower edges 34C,34D. The longitudinal center axis 31 (sometimes referred to herein as simply "the center axis 31") is spaced apart from both the medial and lateral edges 34A,34B. The center axis 31 is spaced equidistantly between some segments 35 of the medial and lateral edges 34A,34B. The segments 35 are portions of the medial and lateral edges 34A,34B which are located at roughly the same position along the longitudinal span of the tongue 30. As described in greater detail below, other portions or segments of the medial and lateral edges 34A,34B, which are also located at roughly the same position along the longitudinal span of the tongue 30, are not equidistantly spaced from the center axis 31. It will therefore be appreciated that the center axis 31 is an axis of asymmetry for the tongue 30.

Still referring to FIGS. 2A and 2B, the center axis 31 divides the tongue 30 into two segments: a medial segment 36 and a lateral segment 38. The medial segment 36 is a portion of the tongue 30 that has a longitudinal span between the upper and lower ends 32,33, and a lateral span between the center axis 31 and the medial edge 34A. The lateral segment 38 is similarly a portion of the tongue 30 that has a longitudinal span between the upper and lower ends 32,33, and a lateral span between the center axis 31 and the lateral edge 34B. A width of each of the medial and lateral segments 36,38 can be measured at different points P1,P2 on the center axis 31. A medial segment width WM of the medial segment 36 is defined along a medial width line 36A extending from the point P1 on the center axis 31 to the segment 35 of the medial edge 34A. Similarly, a lateral segment width WL of the lateral segment 38 is defined along a lateral width line 38A extending from the same point P1 on the center axis 31 to the segment 35 of the lateral edge 34B. In the depicted embodiment, each of the medial width line 36A and the lateral width line 38A are normal to the center axis 31. The lateral and medial segment widths WL,WM at point P1 are the same and are equal. The lateral and medial segment widths WL,WM at point P2 are measured similarly, and are also the same and equal. In FIG. 2A, the widths of the medial and lateral segments 36,38 are therefore the same along at least some points P1,P2 of the center axis 31 for the segments 35 which are located at roughly the same longitudinal span position of the tongue 30. The center axis 31 in the depicted embodiment is an uninterrupted and continuous line, and is free of zig-zags or other deviations.

The point P3 shown in FIG. 2A is on a portion of the center line 31 that is not at the same longitudinal span of the tongue 30 as the segments 35 of the medial and lateral edges 34A,34B. The point P3 shown in FIG. 2A is spaced apart from the points P1,P2. The point P3 is located between the points P1,P2. At the point P3, the lateral segment width WL is different from the medial segment width WM. In the depicted embodiment, the lateral segment width WL is greater than the medial segment width WM at the point P3. In the depicted embodiment, each of the lateral segment width WL and the medial segment width WM are measured along lines that are normal to the center axis 31.

It will therefore be appreciated that at some points P1,P2 on the center axis 31, the lateral and medial segment widths WL,WM are equal, and at other points P3 on the center line 31, the lateral and medial segment widths WL,WM are different and not equal. The widths of the medial and lateral segments 36,38 are therefore not constant at all points along the center axis 31. The widths of the medial and lateral segments 36,38 when measured from at least one same point P3 on the center axis 31 are different. The tongue 31 is therefore asymmetric or not symmetric about its longitudinal center axis 31 because the medial and lateral segments 36,38 are dissimilar. The shape of the medial and lateral segments 36,38 is not the same across the longitudinal center axis 31.

The asymmetric tongue 30 disclosed herein may be better able to conform to the anatomy of the foot F, and may also provide increased comfort for the wearer of the skate 10. Features of the tongue 30 which contribute to its asymmetry are described in greater detail below. These features may be considered to be "comfort" features because they may improve the comfort of the wearer of the skate 10. The examples of comfort features described below are present at locations of the tongue 30 in both the medial and lateral segments 36,38. It will be appreciated that the tongue 30 may have only one of the comfort features described below, and that this sole comfort feature may be disposed in only one of the medial and lateral segments 36,38.

One of the comfort features of the tongue 30 which contributes to its asymmetry is shown in FIGS. 2A and 2B. The medial edge 34A has a recessed segment 39 which has a recessed medial edge 39A. The recessed segment 39 occupies a portion of the longitudinal span of the medial edge 34A. The recessed segment 39 is positioned at a third location of the tongue 30 on the medial segment 36. The recessed segment 39 is disposed on the medial segment 36 at a position between 40% and 90% of the length of the tongue 30 measured from the lower end 33. The recessed medial edge 39A extends inwardly into the body of the tongue 30, and is located closer to the center axis 31 than a remainder of the medial edge 34A. The recessed medial edge 39A is located closer to the lateral edge 34B than a remainder of the medial edge 34A. The recessed medial edge 39A is therefore the portion of the medial edge 34A that is closest to the center axis 31 and to the lateral edge 34B. The recessed medial edge 39A delimits and defines the boundaries of a void 39B. The void 39B is positioned and shaped to receive a portion of the medial malleolus of the foot F. The void 39B in the depicted embodiment is a cut-out of material of the tongue 30 on the medial edge 34A, at a portion of the tongue 30 that is in proximity to the medial malleolus of the foot F when the skate 10 is worn by the user. The void 39B is therefore a space to receive and accommodate the medial malleolus. In the embodiment shown, the medial edge extends towards the longitudinal center axis from an upper end of the cut-out towards a deepest point of the cut-out and extends away from the longitudinal axis from the deepest point towards a bottom end of the cut-out. The recessed medial edge 39A contours the skin S of the foot F at the medial malleolus. By making space for the medial malleolus, the void 39B helps to reduce the likelihood that the medial malleolus will abut against the tongue 30 and cause it to shift or move during the skating motion. In FIG. 2A, the medial segment width WM at point P3 corresponds to the width of the medial segment 36 at a location along recessed medial edge 39A. The medial segment width WM at point P3 is less than the lateral segment width WL at the same point P3.

Another one of the comfort features of the tongue 30 which contributes to its asymmetry is also shown in FIGS. 2A and 2B. The tongue 30 has a tab 40 positioned at a first location of the tongue 30 on the lateral segment 38 adjacent to the upper end 32 of the tongue 30. The tab 40 extends outwardly from the lateral edge 34B in a direction away from the center axis 31. The tab 40 has a distal peripheral edge 41 which extends past the lateral edge 34B. The peripheral edge 41 is spaced apart from the center axis 31 more than the lateral edge 34B. The tab 40 is disposed on the lateral segment 38 at a position greater than 50% of the length of the tongue 30 measured from the lower end 33. The tab 40 is insertable between the top surface T of the foot F and an underside of the lateral side portion 18B of the shell 18. The tab 40 is thus an extension of the tongue 30 at or near the upper end 32 of the tongue 30, on its lateral side, which helps to reduce or prevent frictional rubbing between the lateral side portion 18B of the shell 18 and an upper portion of the top surface T of the foot F. In other words, the tab 40 extends downwardly from a top end to a bottom end. The top end of the tab 40 is spaced apart from the upper end of the tongue. A portion of the lateral edge of the tongue between the top end of the tab 40 and the upper end of the tongue is free of the tab. This frictional rubbing may be caused by some skating motions such as the end of the pushing stroke. Overtime this frictional rubbing may cause pain, and contribute to the phenomenon commonly referred to as "lace bite" or "tongue bite". Lace bite can occur when the laces of the skate bite or dig into the front of the ankle. This can cause excessive pressure on the front part of the ankle and can put significant stress on the tendons underneath the skin. The tab 40 may also protect parts of the fibula by being positioned between the foot F and the shell 18.

Yet another one of the comfort features of the tongue 30 which contributes to its asymmetry is also shown in FIGS. 2A and 2B. The tongue has a protrusion 44 extending from the inner surface 30A towards the top surface T of the foot F. The protrusion 44 is positioned at a second location of the tongue 30 on the lateral segment 38 of the tongue 30. The protrusion 44 is located toward the lower end 33 of the tongue 30, and is positioned closer to the lower end 33 than to the upper end 32. The protrusion 44 is disposed on the lateral segment 38 at a position less than 50% of the length of the tongue 30. The protrusion 44 overlays a portion of the foot F which corresponds to the location of the lateral metatarsal bones 11B of the foot F (see FIG. 1B). The tongue 30 therefore has an additional thickness on part of the lateral segment 38 to fill a space or void created underneath the tongue 30, thereby compensating for the reduced height of the foot F at the location of the lateral metatarsal bones 11B. The increase in thickness of the tongue 30 provided by the protrusion 44 may help to more equally distribute the pressure applied by the laces 19 along the lower part of the foot F. The protrusion 44 defines a local increased thickness of the tongue.

Still referring to FIGS. 2A and 2B, the tongue 30 includes a folding zone 42 extending across both the medial and lateral segments 36,38, and across the width of the tongue 30 between the medial and lateral edges 34A,34B. The folding zone 42 defines a folding axis 42A which is transverse to the center axis 31. The upper and lower ends 32,33 of the tongue 30 are foldable towards one another about the folding axis 42A. The folding zone 42 therefore helps to flex the tongue 30, and in particular, helps in dorsiflexion and plantarflexion of the ankle of the wearer. The folding zone 42, is disposed between the upper and lower ends 32,33 of the tongue 30 to position the folding axis 42A above the top surface T of the foot F and in alignment with a dorsiflexion-plantarflexion axis of the foot F. The dorsiflexion-plantarflexion axis of the ankle of the foot F allows the foot F to flex up and down, and is a medial-lateral axis of the ankle. The folding axis 42A is over top of, or in proximity to, the dorsiflexion-plantarflexion axis. The folding axis 42A is parallel to the dorsiflexion-plantarflexion axis in an embodiment. The folding axis 42A is thus aligned with a lower articulation of the ankle of the foot F.

FIGS. 3A to 3E shows the tongue 130' for use with the left foot F of the wearer of the skate 10, and the tongue 130" for use with the right foot F of the wearer of the skate 10, according to another embodiment. Each of the tongues 130',130" is similar to the tongue 30 described above, and like reference numbers are used to denote like features. Features of the tongue 30 described above which are not provided with a reference number in FIG. 3A to 3E are still present in the tongues 130',130". Each of the tongues 130',130" has the recessed segment 139 with the recessed medial edge 139A. The recessed segment 139 occupies a portion of the longitudinal span of the medial edge 134A. The recessed medial edge 139A extends inwardly into the body of each tongue 130',130". The recessed medial edge 139A delimits and defines the boundaries of the void 139B which is positioned and shaped to receive a portion of the medial malleolus of the foot F.

Each of the tongues 130',130" includes the tab 140 extending outwardly from the lateral edge 134B. The tab 140 and its distal peripheral edge 141 are insertable between the top surface T of the foot F and an underside of the lateral side portion 18B of the shell 18. The tab 140 is thus an extension at or near the upper end 132 of each tongue 130',130", on their lateral sides, which helps to reduce or prevent frictional rubbing between the lateral side portion 18B of the shell 18 and an upper portion of the top surface T of the foot F.

Each of the tongues 130',130" has the protrusion 144 extending from the inner surface 130A towards the top surface T of the foot F. The protrusion 144 is located toward the lower end 133 of each tongue 130',130", and is positioned closer to the lower end 133 than to the upper end 132. The protrusion 144 overlays a portion of the foot F which corresponds to the location of the lateral metatarsal bones 11B of the foot F (see FIG. 1B).

Each of the tongues 130',130" includes the folding zone 142 extending across the width of each tongue 130',130" between the medial and lateral edges 134A,134B. The upper and lower ends 132,133 of each tongue 130',130" are foldable towards one another about the folding axis 142A. The folding zone 142 therefore helps to flex each tongue 130',130", and in particular, helps in dorsiflexion and plantarflexion of the ankle of the wearer. The folding axis 142A is positioned above the top surface T of the foot F and in alignment with the dorsiflexion-plantarflexion axis of the foot F.

The skate 10 disclose herein provides a tongue 30,130' having an anatomical design so that the tongue 30,130' may better conform to the foot F. This improved conformity of the tongue 30,130' may help the tongue 30,130' to remain in place during the skating motion. The tongue 30,130' may therefore provide increased comfort to the wearer.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A skate for a foot of a wearer, the foot having a top surface, a bottom surface, a medial side, and a lateral side, the skate comprising:

a boot having a shell with a bottom portion shaped to enclose the bottom surface of the foot, a lateral side portion shaped to enclose the lateral side of the foot, and a medial side portion shaped to enclose the medial side of the foot, the boot including a toe portion to cover toes of the wearer; and a tongue engaged to the boot and extending along a length between an upper end of the tongue and a lower end of the tongue adjacent to the toe portion of the boot, the tongue having a medial edge adjacent to the medial side portion of the shell and a lateral edge adjacent to the lateral side portion of the shell, a longitudinal center axis of the tongue extending between the upper and lower ends, the tongue being asymmetric relative to the longitudinal center axis, the tongue having a recessed segment with a recessed medial edge, the recessed medial edge being closer to the longitudinal center axis than a remainder of the medial edge, the recessed medial edge of the recessed segment defining a cut-out in the tongue that extends between a first point on the medial edge and a second point on the medial edge, the first point being spaced apart from the upper end of the tongue and the second point being spaced apart from the lower end of the tongue, the cut-out delimiting a void shaped and positioned to receive therein at least a portion of medial malleolus of the wearer, the medial edge extending towards the longitudinal center axis from an upper end of the cut-out towards a deepest point of the cut-out and extending away from the longitudinal axis from the deepest point towards a bottom end of the cut-out, the longitudinal center axis dividing the tongue into a medial segment having a medial segment width defined from a point on the longitudinal center axis to the medial edge, and a lateral segment having a lateral segment width defined from the point on the longitudinal center axis to the lateral edge, the lateral segment width being different from the medial segment width at said point on the longitudinal center axis, wherein the tongue has a tab disposed only on the lateral segment adjacent to the upper end of the tongue, the medial segment of the tongue devoid of a tab, the tab extending outwardly from the lateral edge in a direction away from the longitudinal center axis, the tab being positionable between the top surface of the foot and an underside of the lateral side portion of the shell, the tab extending downwardly from a top end of the tab to a bottom end of the tab, the top end of the tab being spaced apart from the upper end of the tongue, the tab located closer to the upper end of the tongue than the lower end of the tongue, a portion of the lateral edge between the top end of the tab and the upper end of the tongue being free of the tab.

2. The skate as defined in claim 1, wherein the lateral segment width is greater than the medial segment width at the point on the longitudinal center axis.

3. The skate as defined in claim 1, wherein the cut-out being located at a position between 40% and 90% of the length of the tongue measured from the lower end.

4. The skate as defined in claim 1, wherein the medial segment width is defined from the point on the longitudinal center axis to the recessed medial edge, the medial segment width being less than the lateral segment width at the point on the longitudinal center axis.

5. The skate as defined in claim 1, wherein the tongue includes a folding zone extending between the medial and lateral edges and defining a folding axis being transverse to the longitudinal center axis, the upper and lower ends of the tongue being foldable towards one another about the folding axis, the cut-out intersected by the folding axis.

6. The skate as defined in claim 5, wherein the folding zone is disposed between the upper and lower ends of the tongue to position the folding axis above the top surface of the foot and in alignment with a dorsiflexion-plantarflexion axis of the foot.

7. The skate as defined in claim 1, wherein the tongue has an inner surface to face towards the top surface of the foot, and an exposed outer surface, the tongue further comprising a protrusion extending from the inner surface towards the top surface of the foot, the protrusion being positioned only on the lateral segment of the tongue to overlay a portion of the lateral metatarsals of the foot of the wearer, the protrusion defining a local increased thickness of the tongue forming an additional thickness on a part of the lateral segment of the tongue to fill a void created underneath the lateral segment of the tongue.

8. The skate as defined in claim 1, wherein the skate is an ice skate and the shell of the boot is more rigid than the tongue.

9. A tongue adapted to be mounted within a boot of a skate, the tongue comprising:

an upper end and a lower end, and a medial edge and a lateral edge, a longitudinal center axis of the tongue extending between the upper and lower ends and spaced equidistantly between segments of the medial and lateral edges, the longitudinal center axis dividing the tongue into a medial segment having a medial segment width defined from a point on the longitudinal center axis to the medial edge, and a lateral segment having a lateral segment width defined from the point on the longitudinal center axis to the lateral edge, the lateral segment width being different from the medial segment width at the point on the longitudinal center axis; and a tab disposed only on the lateral segment adjacent to the upper end of the tongue, the tongue being asymmetric, the tab extending outwardly from the lateral edge in a direction away from the longitudinal center axis, the tab located closer to the upper end of the tongue than the lower end of the tongue, an inner surface and an exposed outer surface, and a protrusion extending away from the inner surface, the protrusion positioned closer to the lower end of the tongue than to the upper end, the protrusion positioned only on the lateral segment to overlay a portion of lateral metatarsals of a foot, the protrusion forming an additional thickness on a part of the lateral segment of the tongue to fill a void created underneath the lateral segment of the tongue, the protrusion defining a local increased thickness of the tongue, the medial edge defining a cut-out, the medial edge extending towards the longitudinal center axis from an upper end of the cut-out towards a deepest point of the cut-out and extending away from the longitudinal axis from the deepest point towards a bottom end of the cut-out.

10. The tongue as defined in claim 9, wherein the lateral segment width is greater than the medial segment width at the point on the longitudinal center axis.

11. The tongue as defined in claim 9, wherein the medial edge of the tongue has a recessed segment having a recessed medial edge, the recessed medial edge being closer to the longitudinal center axis than a remainder of the medial edge, the recessed medial edge delimiting a void shaped and positioned to receive therein at least a portion of medial malleolus of a wearer of the skate.

12. The tongue as defined in claim 11, wherein the medial segment width is defined from the point on the longitudinal center axis to the recessed medial edge, the medial segment width being less than the lateral segment width at the point on the longitudinal center axis.

13. The tongue as defined in claim 9, further comprising a tab disposed only on the lateral segment adjacent to the upper end of the tongue, the tab extending outwardly from the lateral edge in a direction away from the longitudinal center axis, the tab extending downwardly from a top end of the tab to a bottom end of the tab, the top end of the tab being spaced apart from the upper end of the tongue, a portion of the lateral edge between the top end of the tab and the upper end of the tongue being free of the tab.

14. The tongue as defined in claim 9, further comprising a folding zone extending between the medial and lateral edges and defining a folding axis being transverse to the longitudinal center axis, the upper and lower ends of the tongue being foldable towards one another about the folding axis, the cut-out intersected by the folding axis.

15. The tongue as defined in claim 14, wherein the folding zone is disposed between the upper and lower ends of the tongue to position the folding axis in alignment with a dorsiflexion-plantarflexion axis of a foot.

16. A skate boot comprising a shell defining a foot receiving portion and a tongue mounted within the boot, the tongue comprising:

an upper end, a lower end, a medial edge and a lateral edge, a longitudinal center axis of the tongue extending between the upper and lower ends and spaced substantially equidistantly between segments of the medial and lateral edges, the longitudinal center axis dividing the tongue into a medial segment and a lateral segment, the medial and lateral segments being asymmetrical about the longitudinal center axis, the tongue having an inner surface to face towards a top surface of a foot of a wearer, and an exposed outer surface, and a tab disposed only on the lateral segment adjacent to the upper end of the tongue, the tongue being asymmetric, the tab extending outwardly from the lateral edge in a direction away from the longitudinal center axis, the tab located closer to the upper end of the tongue than the lower end of the tongue, a protrusion extending from the inner surface and away from the exposed outer surface of the tongue, the protrusion defining a local increased thickness of the tongue, the protrusion configured for overlapping a portion of lateral metatarsals of the foot of the wearer, the medial edge defining a cut-out, the medial edge extending towards the longitudinal center axis from an upper end of the cut-out towards a deepest point of the cut-out and extending away from the longitudinal axis from the deepest point towards a bottom end of the cut-out.

17. The skate boot as defined in claim 16, wherein the medial segment has a medial segment width defined from a point on the longitudinal center axis to the medial edge, and the lateral segment has a lateral segment width defined from the point on the longitudinal center axis to the lateral edge, the lateral segment width being different from the medial segment width at the point on the longitudinal center axis, the lateral segment width being greater than the medial segment width at the point on the longitudinal center axis.

18. The skate boot as defined in claim 16, wherein the medial edge of the tongue has a recessed segment having a recessed medial edge, the recessed medial edge being closer to the longitudinal center axis than a remainder of the medial edge, the recessed medial edge delimiting a void shaped and positioned to receive therein at least a portion of medial malleolus of a wearer of the skate boot, a medial segment width being defined from a point on the longitudinal center axis to the recessed medial edge, the medial segment width being less than a lateral segment width at the point on the longitudinal center axis.

19. The skate boot as defined in claim 16, wherein the tab is disposed on the lateral segment at a position greater than 50% of a length of the tongue measured from the lower end.

20. The skate boot as defined in claim 16, wherein the tongue comprises a folding zone extending between the medial and lateral edges and defining a folding axis being transverse to the longitudinal center axis, the upper and lower ends of the tongue being foldable towards one another about the folding axis, the folding zone being disposed between the upper and lower ends of the tongue to position the folding axis in alignment with a dorsiflexion-plantarflexion axis of a foot, the cut-out intersected by the folding axis.

21. The skate boot as defined in claim 16, wherein the protrusion is disposed on the lateral segment at a position less than 50% of the length of the tongue measured from the lower end, the protrusion forming an additional thickness on a part of the lateral segment of the tongue to fill a void created underneath the lateral segment of the tongue.

22. The skate boot as defined in claim 16, wherein the tongue has at least two comfort features disposed thereon, the at least two comfort features including the tab.

23. The skate boot as defined in claim 22, wherein the at least two comfort features include a recessed segment disposed on the medial segment at a location of the tongue, the recessed segment having a recessed medial edge, the recessed medial edge being closer to the lateral edge than a remainder of the medial edge, the recessed medial edge delimiting a void shaped to receive therein at least a portion of medial malleolus of the wearer.

24. The skate as defined in claim 23, wherein the recessed segment is disposed on the medial segment at a position between 40% and 90% of a length of the tongue measured from the lower end.

* * * * *